United States Patent [19]

Orozco et al.

[11] 3,974,674

[45] Aug. 17, 1976

[54] COMPOSITION FOR AND METHOD FOR PREPARATION OF METAL FOR SUBSEQUENT COLD WORKING

[75] Inventors: Gilbert H. Orozco, Euclid; Donald N. Logsdon, Cleveland, both of Ohio

[73] Assignee: Man-Gill Chemical Company, Cleveland, Ohio

[22] Filed: May 20, 1974

[21] Appl. No.: 471,326

Related U.S. Application Data

[63] Continuation-in-part of Ser. No. 323,067, Jan. 12, 1973, abandoned.

[52] U.S. Cl. ..... 72/42; 252/25; 252/18; 427/156

[51] Int. Cl.[2] ..... C10M 3/18; C10M 5/14; C10M 7/20; C10M 7/24

[58] Field of Search ..... 252/12, 18, 25, 42.1; 72/42; 117/134, 119.2, 119.6

[56] References Cited

UNITED STATES PATENTS

| | | | |
|---|---|---|---|
| 2,578,586 | 12/1951 | Orozco et al. | 252/18 |
| 2,588,234 | 3/1952 | Henricks | 252/18 |
| 3,496,104 | 2/1970 | Shimada et al. | 252/49.5 |
| 3,725,274 | 4/1973 | Orozco | 252/42.1 |

*Primary Examiner*—Delbert E. Gantz
*Assistant Examiner*—I. Vaughn
*Attorney, Agent, or Firm*—Fay & Sharpe

[57] ABSTRACT

Steel suitable for cold deformation, and particularly hot rolled steel strip, wire, etc., may be prepared at high speed for subsequent cold working by coating it with an aqueous dispersion of novel composition comprising a high-titre soap (preferably sodium stearate), a suitable phosphorous-containing viscosity regulator for aqueous suspensions and plasticizer for the dry film formed by said soap, a water soluble hydroxyl-containing film-forming polymer, at least one water-soluble pigment such as borax, and water-soluble reaction product of an alkylvinylether with an alpha-beta unsaturated carboxylic acid or anhydride thereof forming a molten film essentially free of water (other than water of hydration) from said coating by removing water while the entire film is at a temperature at least above the solidification temperature of the combined film-forming ingredients and cooling the molten film to the solid state preferably with the aid of cooling air directed against the surface of the molten film. The coating thus formed functions as an exceptional drawing lubricant permitting subsequent cold forming operations without applying added lubricant.

24 Claims, No Drawings

COMPOSITION FOR AND METHOD FOR PREPARATION OF METAL FOR SUBSEQUENT COLD WORKING

This application is a continuation in part of our prior application, Ser. No. 323,067, filed Jan. 12, 1973, entitled Composition For And Method For Preparation Of Metal For Cold Working and now abandoned. In accordance with the prior application of Gilbert H. Orozco, Ser. No. 89,083, now U.S. Pat. No. 3,725,274 which was copending with said SN 323,067, metal was prepared for cold working by coating it with an aqueous soap base lubricant comprising a water-soluble inorganic pigment, preferably borax and sodium nitrite, preferably a high molecular weight ester of phosphoric acid, and at least one of the group consisting of water-soluble organic polymer and hydrophillic carbohydrates to control viscosity. The coating is applied under conditions wherein the metal is heated above 150° F. and preferably 170° F. to 200° F. where excess water is vaporized and a molten soap base still produced. The film is then rapidly and artificially cooled with air jets to chill the film to the solid state.

While the invention as described in Mr. Orozco's patent, is suitable for most applications wherein metal is drawn, it has been found that it is not possible to set the film with sufficient rapidity to permit its effective use in high-speed steel mills, particularly in the case of strip mills. The steel companies insist on speeds of around 300–400 feet per minute and will not permit sufficient space in which to apply the coating, flash off, water and set the film at such speeds. This maximum space available is usually around 50–60 feet.

It is apparent that the titre of the soap will have an effect on the rate of set or temperature of set of the film. While the titre of a high-titre soap has ordinarily been considered in the excess of 35° C. or 40° C., even with a 40° C. to 43° C. high-titre soap, as is commercially available, the flashing off of the moisture of the surface of the coated article and the setting of the film cannot proceed with sufficient rapidity to allow a speed anywhere near the desired 300–400 feet per minute required in the steel mill.

It is therefore an object of the present invention to provide a composition that may be applied to hot steel and may be caused to set up to a suitable solid dry film at speeds up to 400 feet per minute in a 50–60 foot space.

Another object of the present invention is to provide a solid film on bare steel that will permit effective drawing or deformation of the metal and which may be applied at speeds up to 400 feet per minute in a steel mill.

A further object of the invention is to provide a composition for drawing or forming metal which forms films essentially free of water (except water of hydration), after application of an aqueous dispersion of said composition to the metal at temperatures as low as 130° F. or even 110° F.

A still further object of the present invention is to provide a method for drawing metal which does not require a phosphate or oxylate conversion coating on the metal.

Other objects will be apparent from the following description of the invention and as claimed in the appended claims.

A major aspect of the present invention is as described in our prior application, particularly directed to improvements in the compositions and the methods so as to permit the application and setting of the coating at speeds required in the steel mill so that the strip, wire, or other material as made can be coated at the steel mill with the coating of the present invention and shipped to the fibricators who cold work the metal so that the latter does not have to apply any drawing lubricant to the surface of the metal in order to produce deep drawn articles.

In accordance with that major aspect as stated in our prior application, we have found that soaps may be obtained with a titre as high as 58° C. or 60° C. These soaps have in the past often been considered undesirable, and in some cases have been sold at reduced prices. The ultra-pure stearates have also often been sold at premium prices for use in compounding of certain plastics. It seemed that the solution of the problem of speed coating of set should be a function of the titre of the soap, and that since these exceptionally high-titre soaps had a titre as much as 18° C. to 20° C. above the ordinary high-titre soap, then by simply using such high-titre soaps in place of those previously used, one would obtain the desired speed of set to permit high speed operation in the steel mills. However, it was found that when these very high-titre soaps were merely substituted for the soaps previously used that other problems arose.

Even though the metal was heated to 170° F., a plastic non-solid film was formed. Apparently the outer surface of the film as applied cooled and set to a solid before the moisture was removed from the remainder of the soap base film. This resulted in an outer surface coating which covered a soft plastic solution of material. The outer layer of solid delayed or prevented removal of moisture from the solution below it. The moisture in the film had not been reduced sufficiently by the heat of the metal before the outer surface had set. This problem could be solved either by heating the metal to a much higher temperature and/or by applying a hot air blast to remove the moisture in the film and then applying the rapid chilling of dry but molten film by the cooled air jets applied against the surface of the film.

It was also found, however, that when the very high-titre soaps were merely substituted for those soaps in the prior composition described in Orozco U.S. Pat. No. 3,725,274, the film became hard and powdery and did not adhere well enough to function in certain cases. Undesirable build-up occurred on the dies used. This problem was solved, as described herein, by incorporating a small amount of suitable plasticizer into the film which did not reduce the setting temperature an appreciable amount, but did eliminate the problems with powdery films.

It was further discovered that it is possible to have the surface of the metal too smooth to permit effective drawability of the coated material. While most hot rolled pickled metal surfaces have a roughness factor sufficient to permit use of the composition without any integral phosphate pretreatment, it is found that when the compositions are applied to metal with micro-finishes of the order of five or less which are characteristic of glass, the material does not have sufficient adhesion to function properly when the coated material is drawn over areas of small radii. When micro-finishes on the steel are less than 30, it is therefore desirable to provide the steel with a suitable phosphate finish, such as an iron phosphate or a zinc-iron phosphate, which will produce a roughness factor as required to prevent slippage of the material from the surface of the metal during drawing. Most drawing steels have a roughness factor or micro-finish of about 40 or above, and no phosphate or oxalate or sulfurized integral coating is required for the metal. The combination herein after described does, however, permit drawing of steels with micro-finish considerably less than 40 without use of the integral conversion coating.

The absence of an integral coating thus permits the elimination of the undesirable phosphates and oxalates from the steel industry and the resultant contamination of the water supplies; phosphate contamination of the lakes and rivers being the main reason for the great growth of algae.

In accordance with present invention, the metal, in the form desired; for example, in the form of sheets, strip, rods, wire, bars, tubes, etc., to be cold worked is roller-, dip-, or spray-coated with a thin layer of the drawing composition (as hereinafter more fully described) comprising essentially an aqueous dispersion of a high-titre soap (preferably sodium stearate), a suitable plasticizer for the soap, a viscosity stabilizer (said plasticizer and said stabilizer may be one material), two water soluble polymeric materials capable of condensing with each other and forming cross links upon drying of the coating, and a water soluble glass-forming pigment such as borax (or equivalent) and preferably a small amount of a pigment, preferably one such as fine calcium carbonate to form with fatty acids a water insoluble soap. The coating takes place under conditions in which a molten film essentially free of water (other than water of hydration) is obtained. The molten film is preferably quickly set to solid state by high volume flow of air at a temperature below the solidification temperature of the coating. This forms a solid film of the drawing composition on the metal surface. For the highest speed operation (about 400 feet per minute) in a strip mill, films having a setting or solidification temperature of 160° F. to 180° F. have been found to be satisfactory with solutions and steel input temperatures of about 170° F. to 200° F. However, because of the cross-linking action of the said reaction product on the water-soluble hydroxl-containing polymer, films with a much lower solidifying temperature may be used for most applications. The highest speed of film set is obtained with the use of the very high-titre soap and accompanying high temperature of solidification.

It is found necessary that the entire depth of the applied film be freed from solubilizing moisture before solidification occurs; otherwise a plastic and unusable coating results. The moisture may be removed either by having the metal at a sufficiently high temperature to flash off the solubilizing moisture or by use of sufficient heated air applied to the surface of the metal right after the coating is applied or by use of both, followed by the cooled or colder air where the film is preferably quickly set to the solid state.

While the speed and temperature of the air should be sufficient to form a solid film in the time allotted (usually in modern steel mills a distance of 25 or 30 feet before the coated strip is coiled) care must be taken not to use such strong blasts of air that the films are entirely blown off the metal while they are in the liquid (solution or molten) stage. It has been found that air blasts of 8,000 cubic feet per minute through ½ inch to ¾ inch nozzles placed 6 inches from the coated surface of the metal are satisfactory. The effect of the air may be modified, as is well known, either by changing air velocity or by positioning the nozzles nearer or farther from the surface or by changing air temperature. When such air blasts are used a sufficient number of nozzles should be used to cool the entire metal surface below solidification temperature of the film before the metal is coiled.

If the temperature of the steel is the sole source of heat relied upon to remove the water of solution from the film and the very high-titre soap is used, the steel should be at a minimum temperature of 170° F. for application of the solid coating to strip in a space of 25 feet at a speed of 300 feet per minute. Steel temperatures of about 180° F. or 200° F. are preferred, and cooling air temperatures of around 60° F. are highly desirable. The air must be quite dry as air laden with moisture from previous use cannot properly be recirculated.

While in a strip mill speed of set of the film to a not tacky adherent state is a major consideration in determining whether a composition may be used; there are major applications where that is not the case. In such cases a composition with much longer speed of set or solidification may be used. There include tube drawing, bar forming, cold heading, automobile bumper formation, and a host of other items. In such cases a lower titre soap, even as low as (40° C.) 40 titre may be used. In such a case even more reliance is based on the reaction of the two polymers for initial set of the film to the non-tacky state. The temperature of the metal when applied may be as low as 110° F. in such instances, although temperatures of 150° F. or higher are still preferred.

One or more water insoluble pigments may also be incorporated in the film in amounts up to even 25 or 30 percent of the weight thereof in the case of pigments which are non-reactive with fatty acids. Such include fume silica or silica aero gels or xerogels, barium sulfate, etc. In the case of reactive water-insoluble pigments such as calcium carbonate, zinc oxide, etc., which form insoluble polyvalent metal soaps, a much smaller maximum amount is desirable, say up to a maximum of 5 percent and preferably 0.1 to 2 percent of the film weight. The very fine pigments may have a reinforcing effect on the polymeric materials as in polymer compounding.

The two water-soluble film-forming polymers are capable of condensing with each other on drying of the film on the metal to give off water, ammmonia, or both. They thus apparently interact to cause set up of the film during the drying operation to a less easily water-soluble state. The one polymer should have a substantial number, at least 10 and preferably 50 or more per molecule of excess carboxyl groups (and/or groups capable of forming carboxyl by hydrolysis or ester interchange, etc.) and the coacting polymer should have at least 10 and preferably 50 or more of hydroxyl and/or amine groups per molecule. Hydroxyl groups are preferably to amine groups and polymers with such are designated as water-soluble film-forming hydroxyl-containing polymers.

The carboxyl-containing polymer, in addition to condensing with the hydroxyl-containing polymer, also functions to react with the surface of the metal to greatly improve adhesion of the resultant fiber. The rate of effective modification of the film by interpolymer reaction upon drying depends largely on both the number of carboxyl and hydroxyl (or amine) groups per molecule and molecular weight of the polymers.

The carboxyl furnishing polymer should have a molecular weight of at least 3,000 and preferably above 5,000, even 100,000 or more, as long as water-solubility is maintained. The polymer must be water-soluble to be readily dispersed and may be a homopolymer of an alpha-beta unsaturated carboxylic acid such as polyacrylic acid or a copolymer with enough excess carboxyl to provide water-solubility and in this connection the formation of colloidal solutions of the polymer in water is considered to be water-solubility.

We have found that copolymers of an alpha-beta carboxylic acid such as maleic acid (usually as its anhydride) fumaric acid or acrylic acid with an alkylvinylether having up to 4 carbons in the alkyl group are excellent. The water-soluble copolymers of methylvinylether with maleic anhydride having 10 to 50 mole percent of maleic anhydride or acid residue are especially desirable. The water-soluble copolymers of methylvinylether with 30 to 50 mole percent of maleic anhydride (or maleic or fumaric acids) are outstanding, particularly when the molecular weight is above 20,000. A 1:1 copolymer of methylvinylether and maleic anhydride with a molecular weight of 30,000 is such a product.

The water-soluble hydroxyl-containing and film-forming polymer may be one or more of polyvinylalcohol (preferably partially esterified with a carboxylic acid, e.g. maleic anhydride), polyallyl alcohol, polysaccharides, amylose fraction of corn starch, hydroxyl methyl cellulose, carboxyl ethyl cellulose, hydroxyl ethyl cellulose, etc., and the polymers may be modified by incorporating acetyl groups, propionyl groups, carboxy methyl or methyl illustrated by partly methylated or carboxy-methylated polysaccharides or polyvinylalcohol. They may also be modified by condensation with epoxides, including ethylene and propylene oxides, epichlorohydrin, butadiene monoxide, and butylene oxide. The introduction of such groups should not occur in sufficient amounts to destroy the water-solubility.

The high titre (40 or above) soap is always a main film former of our composition and the plasticizer which decreases brittleness of the soap base material is highly important. I have found that particularly desirable plasticizers for the soap are the mono and diesters of phosphoric acid with the condensates of polyethylene oxide and an alkyl phenol having 6 to 18 carbon atoms in the alkyl group thereof. These materials act as viscosity stabilizers for the aqueous solutions or dispersions to insure formation of a thinner and more uniform coating on the metal. In these esters the proportion of the polyethylene oxide portion which largely provides water-solubility is sufficient to balance the water-insolubilizing effect of the aralkyl group and provide water-solubility. Thus as the alkyl group is increased, the length of the polyethyleneoxide portion is increased, as is well known in the art to provide the surface activity and resultant viscosity stabilization.

The water-soluble glass-forming pigment is preferably borax, however, all or part may be replaced by other glass-forming salts including trisodium phosphate, tetra potassium pyrophosphate, etc. Because of the detrimental effects of phosphates on the ecology, the glass forming pigment is preferably borax.

A composition which has been found to be highly suitable for application to the metal at the tail end of a high-speed strip mill, etc., is an aqueous solution of 4 ounces to 2 pounds per gallon (usually about 10 to 18 ounces per gallon) of a mixture of the composition of Table 1.

TABLE 1

| | Parts by Weight (Optimum) | Parts by Weight |
|---|---|---|
| Borax (.10 $H_2O$) | 57.0 | 30 to 75 |
| Soda Ash | 4.5 | 0 to 10 |
| Sodium Nitrite | 5.0 | 0 to 10 |
| Dispersable Calcium Stearate | 3.0 | 0 to 10 |
| Sodium Stearate, 55–63 titer | 20.0 | 10 to 80 |
| Water-soluble Film-forming Polymer Reaction Product of Equal Moles of Alkyl Vinyl Ether and Maleic Anhydride 30,000 M.W. | 1.5 | 0.5 to 4 |
| Mono or Di Ester of Phosphoric Acid and Nonylphenoxypoly(ethyleneoxy)-ethanol | 2.0 | 1 to 5 |
| Water to Permit Easier Blending | 2.0 | Variable |

The very high-titre sodium stearate may in most cases be substituted by a mixture of the very-high titre sodium stearate and another soap of somewhat lower titre. Thus in the above, 10 parts of Proctor and Gamble Rubber reserve soap of 40–50 titre (actually 44–50 titre) and iodine value 68 maximum may be used with 10 parts of the very high, 55–60, titre sodium stearate. When speed of set is not critical other alkali metal soaps of fatty acids of 14 to 22 carbon atoms may be used. Thus a soap such as sodium palmitate may also be present as the soap constituent. Soaps of 40° C. titre and higher give best results. The soap acts as the primary binder and film-former for the composition. When dry, it also functions as a lubricating constituent. The borax (a glass-forming pigment) not only acts as a very high temperature lubricant, but also makes the soaps or soap solution less viscous.

The water-soluble carboxyl-containing film-forming polymer in the above Table is the reaction product of equal moles of methyl vinyl ether and maleic anhydride. Whether it is called a condensation product as in our prior application or a reaction product, it is properly defined as a copolymer or within the generic term polymer.

While the preferred vinyl ether used is the methylvinylether, other alkyl-vinyl ethers with up to 5 carbons in the alkyl group (including ethyl and propyl) may be used with about equivalent results. The maleic anhydride used in forming the copolymer product may be substituted by other alpha-beta unsaturated mono and dicarboxylic acids, including fumaric, acrylic, and cinnamic acids. The mole ratios of the ingredients can be varied as long as water-solubility of the copolymer or interpolymer results, about equal moles of the ingredients are preferred. It is seen that these polymers are characterized by a long chain of carbon atoms from which depend carboxyl and methoxy groups. Similar results are obtained by other polymers such as polyacrylic acid which comprise a carbon atom chain from which depend carboxyl groups or groups which form carboxyl. These polymers are preferably used in amounts equal to 1/3 the weight of the coactive hydroxyl- or amine-containing polymer.

The particular water-soluble film-forming polymer in the above Table is polyvinyl alcohol having a part of the hydroxyl groups modified by maleic anhydride treatment. Other hydroxyl-containing polymers, as above set forth, may be substituted in whole or in part. Also a water-soluble polymeric amine such as that prepared by reduction of polyacrylamide with lithium aluminum hydride or that prepared by treating polyacrylamide with sodium hypochlorite or sodium hypobromite may also be used in place of all or part of the water-soluble hydroxyl-containing polymer. The number of amine and/or hydroxyl groups per mole is sufficient to provide water-solubility at the particular molecular weight of the polymer, which is above 2,000 and preferably 5,000 to 500,000.

The mono and diesters above may be substituted by other water-soluble phosphate esters of the general formulae: $R(C_2H_4O)_nPO_3H$ and $R(C_2H_4O)_nPO_3H_2$ where $n$ is 3 to 25 and R is an oxyhydrocarbon group of 8 to 24 carbon atoms, including oxyalkyl such as lauryloxy and hexadecyloxy, or aralkyloxy such as octyl-, nonyl-, and dodecylphenoxy. R may, however, also be aceyloxy, i.e., $$-O-\underset{\underset{O}{\|}}{C}-R_1,$$

where $R_1$ is a hydrocarbon group of 8 to 24 carbon atoms, including aralkyl such as nonyl-phenol, alkyl such as nonyl, octadecyl, etc., or HR may be a mono or diester of a polyhydric alcohol having 3 to 4 inclusive hydroxyls with a fatty acid, including the mono and dioleates of glycerol and sorbitan. Some of the advantages may be obtained with the anionic and non-ionic phosphorous-free agents containing a poly(ethyleneoxy) linkage, including polyoxyethylene sorbitan monostearate and alkyl poly(ethyleneoxy) ethanol having 10 to 24 carbons in the alkyl group.

Sodium nitrite, if present, acts to inhibit rust formation and acts with the borax as a meltable inorganic pigment to provide a further step in the step-wide lubrication.

The calcium stearate, if present, also acts as a meltable pigment to provide lubrication. It need not be used in most drawing applications, but does contribute to the lubricity of the compound. Other polyvalent metal stearates and water insoluble soaps in dispersible form, including lead, aluminum, barium, magnesium, strontium and tin stearates, palmitates, etc., may be used in place of all or part of the calcium stearate.

The soda ash, if present, acts both as a lubricating pigment with borax and the sodium nitrite and as a neutralizer to take care of any undesirable acidity. It may or may not be present, but it is desirable.

Even in the dry compound as packaged for shipment, a small amount of water is desirable as it facilitates blending of the various dry substances. The water which is added to the dry compounding agents in preparing the dry blend that is later dissolved, as aforesaid, to provide a solution having optimally about 10 to 18 ounces per U.S. gallon, does not generally exceed 2 or 3 parts, but more may be added if desired. The dry compound, being designed for simple addition to water at the steel mill, is preferably as dry as manufacturing operations permit, so as to decrease shipping costs.

The following example illustrates the process of preparing metal for cold working at the steel mill:

EXAMPLE 1

Dry compounds were prepared having the ingredients identical to those of Table 1, proportioned as in the column headed "optimum," except in one case where the sodium stearate used had a titre of 57 to 60 and in another case where the sodium stearate soap was substituted by a soap of 40 to 43 titre. The compounds were dissolved in water in the proportions of 16 ounces of the dry compound to 1 gallon of water to provide solutions, A and B, having respectively the 57 to 60 titre and the 40 to 43 titre soaps. Hot rolled pickled steel strip, 0.191 inches in thickness with a microfinish of about 40, heated to the temperature shown in the following table, was roller coated with the solutions; rollers and solutions being held at a temperature of 170° F., and passed through the equivalent of a 25 foot-long chamber equipped with uniformly spaced ¾ inch diameter nozzles situated 6 inches from the surface of the film on the steel.

The nozzles were directed against both upper and lower coated surfaces of the strip and except in Run K, air velocity was 8,000 feet per minute through each nozzle. In Runs A through I, inclusive, solution A, the highest titre soap, was utilized; and in Runs J through N, solution B, having the lower titre soap, was used. In Run K of the following table, air velocity was 9,000 feet per minute. The outside air was 70° F. to 71° F. The temperature of the air at the nozzles was as shown in the following table. The seconds permitted for the film to dry and set are also shown in Table 2.

TABLE 2

| Run | Steel Temp. (°F.) | Outside Air Temp. (°F.) | Nozzle Air Temp. (°F.) | Time In Chamber (sec.) |
|---|---|---|---|---|
| 57 to 60 Titer | | | | |
| A | 178 | 70 | 90 | 6.00 |
| B | 176 | 71 | 90 | 5.00 |
| C | 175 | 70 | 89 | 3.75 |
| D | 177 | 70 | 90 | 3.75 |
| E | 200 | 70 | 91 | 3.75 |
| F | 200 | (Dried) | 60 | 3.75 |
| G | 180 | (Dried) | 60 | 3.75 |
| H | 170 | (Dried) | 59 | 3.75 |
| I | 200 | (Dried) | 62 | 3.00 |
| 40 to 43 Titer | | | | |

TABLE 2-continued

| | | | | |
|---|---|---|---|---|
| J | 177 | 70 | 82 | 6.00 |
| K | 180 | 70 | 82 | 5.00 |
| L | 176 | 70 | 82 | 5.00 |
| M | 177 | 70 | 87 | 5.00 |
| N | 179 | 70 | 88 | 6.00 |

| Run | Speed (Feet Per Minute) | Temp. Steel Out | Film Quality |
|---|---|---|---|
| 57 to 60 Titer | | | |
| A | 250 | 165 | good |
| B | 300 | 170 | good |
| C | 400 | 168 | tacky |
| D | 400 | 170 | tacky |
| E | 400 | 188 | tacky |
| F | 400 | 180 | good |
| G | 400 | 165 | good |
| H | 400 | 160 | tacky |
| Iq | 500 | 190 | tacky |
| 40 to 43 Titer | | | |
| J | 250 | 165 | good |
| K | 300 | 170 | blew off |
| L | 300 | 165 | good |
| M | 300 | 168 | blew off |
| N | 250 | 165 | good |

It is seen from the above that one must take into account the steel temperature, its retained heat, and adjust speed and cooling air temperature accordingly. A thinner steel strip will be cooled more rapidly. The film may be reduced in temperature when the above composition is used to about 180° F. or below. When the speed is such that the drying and setting time is 5 seconds or more, even ambient air could be used in the nozzles. When air velocity was too great, as in Run K, the film simply blew off the metal before it dried.

Only in cases where a good quality (non-tacky) solid dry film was produced was the coated metal satisfactory for factory drawing operations. With good quality films, metals as ordinarily supplied, having a microfinish (or roughness factor) of above 10, are repeatedly drawn in factory operations without difficulties. Gummy films which were formed without the cooling air by permitting the coating to simply freeze on the metal are not satisfactory for factory operations involving mass production of a given part.

Temperatures in excess of 350° F. produced no charring of the film and had no adverse effect, such as loss of adhesion or hardness. Only the microfinish on the steel is less that 10 is a real advantage found by the use of the ordinarily used integral phosphate or oxalate or sulfurized coating.

It is therefore entirely unnecessary to apply and strip such integral coatings with the inherent deleterious results on the environment.

EXAMPLE 2

Four separate compositions are prepared according to the optimum formulation. Table 1 except (1) that the dispersible calcium stearate is eliminated and substituted by a very small amount of calcium carbonate and (2) the titre of the sodium stearate was varied. In Composition (A) the sodium stearate has a titre of 53 to 55 and the calcium carbonate was 0.2 percent of the dry ingredients. The set point of films deposited on steel is about 160° F. In Composition (B) the sodium stearate has a titre of 47–49 and the fine calcium carbonate powder was 0.2 percent by weight of the dry ingredients. The set point is about 150° F. In Composition (C) the titre of the sodium stearate is 40–42 and the calcium carbonate powder is 2 percent of the weight of the dried film. Set point is about 136° F. Composition (D) is formed of 2 parts of Composition (C) and 1 part of Composition (B), the calcium carbonate is 1.4 percent and the set is about 150° F.

EXAMPLE 3

Unpickled low carbon (SAE 1015) steel tubes, 18 to 20 feet in length, were immersed in an aqueous bath formed by dissolving 16 ounces per gallon of Composition (D) of Example 2 in water. The bath was maintained at 190° F. The tubes were drained and air forced through their interiors to dry and set the film. They were drawn satisfactorily over a mandrel without the need of the integral phosphate coating heretofore always necessary when other lubricants were used. The reduction per draw was above 30 percent.

EXAMPLE 4

The tubes of low carbon steel were, in Example 3, successively substituted by annealed and pickled tubes of SAE TIA Molydenum Alloy steel; Tubes of SAE T5 Chromium Alloy steel and Tubes SAE T11, 1 ¼ percent Chromium Alloy steel. In each case the coating was applied as described in Example 3. Even at reductions as high as 45 percent, the drawing was entirely satisfactory.

Drawing of seamless tubes is probably the most difficult of all drawing and forming operations for the reason that the formation of a uniform coating of most lubricants on the interior of tubes is most difficult without use of an integral phosphate or oxylate conversion coating. The steam or moist vapors during the drying step causes flow of the coating from portions of the tubes leaving a puddle at the lower portion of the tube and a bare upper portion. Failure thereupon occurs.

EXAMPLE 5

Oven wrappers at a large stove manufacturing concern in Maryland were being drawn by coating the blank with a competitor's composition which consisted essentially of soap and borax and anionic polymer dispersing agent obtained under the trademark, Tamol, from the Rohm & Haas Company. The oven wrapper is the inner lining of the oven and comprises the side walls which have a series of grooves to receive the racks. It is in these grooves that trouble had occured. The manufacturer had been unable to draw the wrappers except when they were heated. The blanks, while at about 170° F., were roller-coated with a solution of 16 ounces per gallon of the Composition (A) of Example 2 which solution was maintained at about 180° F. They were simply air dried, without air jets, in a drying oven at 275° F. which was the lowest temperature available and allowed to cool. The drawing became so satisfactory that production drawing of the wrappers was continued with either cold or hot blanks without any difficulty.

EXAMPLE 6

In order to show the effect of the water-soluble carboxyl-containing polymer in the combination wherein a water-soluble hydroxyl-containing polymer was present with the soap, a pair of runs at Toledo Pickling and Steel Service Company, Toledo, Ohio, were made to show the marked effect of the carboxyl-containing polymer alone, using the high titre sodium stearate (43 titre). In one run that polymer was omitted and in the other conditions were the same except the carboxyl-containing polymer was present. The basic composition listing the carboxyl-containing polymer as present and in which parts are by weight is as follows:

20.0 parts of 42 titre soap
5.0 parts of sodium nitrite
.2 parts of calcium carbonate
1.8 parts of water
2.0 parts of phosphate ester
5.0 parts of water soluble polymer
1.5 parts of the 1:1 copolymer of methylvinylether and maleic anhydride
59.5 parts of borax (10 moles $H_2O$)
5.0 parts of soda ash A 12 percent solution of the above solids was applied in each case by the roller coating method and drid by air jets in a Hoffman Drier. The addition of the 1.5 percent of the said copolymer so greatly decreased the drying time that a 50 percent increase in speed was permitted over that possible when it was absent.

When the very high titre soap was used in place of the 43 titre soap in the same composition, a further substantial increase in drying speed is attained. Without the said copolymer, adhesion to the metal was very faulty. Furthermore, we have found that while a carboxyl-containing copolymer is a big factor in adhesion of the soap to the metal, moisture resistance and rust protection are also greatly increased, as well as decreased drying time. Without the copolymer (or an equivalent high film-forming polymer having depending carboxyl groups) the films on storage become gummy. Apparently, the improved rust protection is the result of a more continuous film because of the cross-linking effect of the many carboxyl groups (50 or more per molecule) on the water-soluble film-forming polymer.

EXAMPLE 7

At the Toledo Pickling and Steel Service Company, Toledo, Ohio, hot rolled steel of approximately 11 gauge thickness was coated by the roller coating method with a water-dispersion of a mixture consisting essentially of 3 percent carbo-wax 4000, 5 percent of a water-soluble polyvinyl alcohol derivative, 20 percent of 40–42 titre soap, 5 percent sodium nitrite, 3 percent dispersible calcium stearate, and 64 percent borax. With the high titre sodium stearate, set forth the coating became gelatinous and would not level out uniformly so that increased drying time and lower speed was required than is permitted by the unmodified composition as set forth in Table 1, page 12 hereof. The coating on the metal, even with the roller coating, looked "wormy" and the product was unsuitable for use in production. When a mono or diester of phosphoric acid and the condensate of nonylphenol and polyethylene oxide in the amount of 2 percent based on the total solids was incorporated into the material above described, the viscosity of the material became very noticeably less and a thinner film was produced by the same coating process; the material leveled out, did not become gelatinous, and the film had a smooth appearance. The coated product was highly successful in production.

When a composition corresponding to that of Table 1 above was modified by eliminating the carboxyl-containing polymer but maintaining the phosphoric acid ester, the adhesion when using very high titre sodium stearate (53°–62° C. titre) became faulty, the drying time was greatly increased over the time when the composition of Table 1 was used without any modification. The film was brittle and powdery and unsuitable for use. When the composition of Table 1 (with the carboxyl-containing polymer present) was substituted, the same conditions being maintained, the film became adhesive, non-powdery, pliable, and more moisture-resistant.

EXAMPLE 8

Bare flat polished automobile bumper blanks are cleaned with a commercial cleaner rinsed by hot water to both remove the cleaner and to preheat the metal to at least about 170° F. A coating solution of 16 ounces per gallon of Composition (A) of Example 2 is roller coated thereon and the water permitted to evaporate in a suitable drying oven at about 170° F. The molten film is cooled well below set temperature of about 160° F. The blanks are then drawn in the desired shape of automobile bumpers without difficulties. No phosphate or oxalate is required.

Very important considerations in drawing are the thickness of the coating or amount of coverage in square feet per pound; whether or not the coating can be readily removed, and rust protection or resistance of the coated article to humidity. It is found that where competitor's coatings require barrels of the dry compound to effectively draw, as little as 100 pounds of the compositions of the present invention suffice.

Even with a coating of 250 Mg/sq. foot present on sheet metal, satisfactory spot welding takes place. The material passed the rigorous Ford specification spot welding test.

The coating is readily removed with either a spray or a soak in an aqueous solution of a commercial cleaning agent such as the commonly used alkali cleaners.

When steel panels, coated respectively with composition of the present invention and 4 competing dry film lubricants, were placed in a Cleveland humidity cabinet, the panel coated with our invention lasted 192 hours before rust began. Panels coated with competitor's coatings began to rust at 48 hours, 96 hours, 4 hours, and 48 hours respectively.

Apparently because of the cross-linking and reactive nature of the two polymers, our coatings are unaffected by short exposure to hot water vapor over a beaker (vapor test) which may account to some extent for the remarkable performance in coating the interior of steel tubes.

The carboxyl-reactive water-soluble polymer used is preferably a polyvinyl alcohol having only a portion of the possible hydroxyl groups present. These must be sufficient to cause water-solubility but insufficient to cause the aqueous solution of the mixture containing the specified amounts of carboxyl-reactive and carboxyl-containing polymers to gel before it is applied to the metal as a coating, polyvinyl alcohol having 10 to about 50 percent of the possible free hydroxyl groups is usually preferred. The optimum proportions of hydroxyls to possible hydroxyls depends to some extent on molecular weight and is less at the higher molecular weights as it then takes less cross-linking to cause gellation in the aqueous mixture.

We find that the proportion of hydroxyl may be varied by several means (1) by varying the degree of possible hydrolysis from the original polyvinyl acetate, (2) by modification of a polyvinyl alcohol that a trial shows that it gels in the aqueous solution of the mixture. Thus a high M. W. polyvinyl alcohol having say 70 percent or more of the maximum possible hydroxyls and which causes gel formation in the aqueous mixture, may be treated to block some of the hydroxyl groups by treatment with carboxylic acid to esterify some or by treatment with an aldehyde to acetalize some but leave sufficient for final cross-linking on drying. The esterification may be by a mono-carboxylic acid such as acetic, formic, etc., or by an anhydride of a mono or dicarboxylic acid. Acetalization is accomplished by use of an aldehyde, preferably acetaldehyde, in presence of very small amounts of dry HCl, etc.

In the appended claims, the term carboxyl groups is intended to include groups such as anhydride which form carboxyl in use.

While we have described our invention with particular reference to ferrous metals, such as cold and hot rolled steel, stainless steel, and the like, it is also applicable to the drawing and cold working of other metals, including titanium and nickel, any alloys such as monel metal, which may not contain any iron.

Various modifications of the invention may be made without departing from the spirit thereof. It is intended that the invention be limited only by the appended claims.

Having described our invention, we claim:

1. A metal-forming composition suitable for mixing with water and forming a dispersion for application to metal surfaces to form thereon a dried solid film comprising a mixture consisting essentially of 30 to 75 parts of a water-soluble glass-forming solid pigment selected from the group consisting of alkali metal phosphates and borax, 0 to 10 parts of an alkali metal nitrite, 0 to 2 parts of fine $CaCO_3$, 0 to 10 parts of calcium stearate, 0 to 30 parts of fine inorganic pigment selected from the group consisting of silica aerogels, silica xerogels, fume silica, and barium sulfate, 10 to 80 parts of an alkali metal fatty acid soap having a titre of at least 40°C.; two water-soluble polymers, one being present in amounts of 1 to 10 parts by weight and having a molecular weight above 2,000 being film-forming and having per molecule at least 10 carboxyl-reactive groups, and the other being present in amounts of 0.5 to 4 parts by weight and having a molecular weight of at least 3,000 and having at least 10 carboxyl groups per molecule, and 1 to 5 parts of a surface active agent containing a polyethylene oxide linkage connected to a hydrophobic group, which comprises an alkylphenol.

2. The composition of claim 1 wherein the glass-forming pigment is principally borax and the surface active agent is a member of the group consisting of mono and diesters of phosphoric acid with a condensation product of ethylene oxide and an alkyl phenol having 6 to 18 carbon atoms in the alkyl group thereof, said condensation products having a poly(ethyleneoxy) portion with 3 to 25 ethyleneoxy units.

3. The composition of claim 2 wherein the carboxyl-reactive polymer has a molecular weight greater than 5,000 and contains at least 50 hydroxyl groups in molecules thereof and the alkali metal nitrite is $NaNO_2$.

4. The composition of claim 2 wherein the carboxyl-reactive polymer has a molecular weight of above 20,000 and contains at least 50 carboxyl-reactive groups in molecules thereof.

5. The composition of claim 2 wherein the carboxyl-reactive polymer is a hydroxyl-containing water-soluble film-forming polymer selected from at least one member of the group consisting of polyvinylalcohol, polyallylalcohol, polysaccharides, amylose fraction of corn starch, methylated and carboxylated derivatives of the foregoing group members, hydroxymethylcellulose, hydroxyethylcellulose, carboxymethylcellulose, and water-soluble condensation products of a foregoing group member with an epoxide selected from ethylene oxide, propylene oxide, butylene oxide, butadiene monoxide, and epichlorhydrin, and the coactive water-soluble carboxyl-containing polymerization product of an alpha-beta unsaturated carboxylic acid selected from the group consisting of maleic, fumaric and acrylic acids, with alkyl-vinyl ether having up to 4 carbons in the alkyl group thereof.

6. The composition of claim 5 wherein the carboxyl-containing polymer is a copolymer of an alpha-beta unsaturated dicarboxylic acid and having 4 carbon atoms with an alkyl vinyl ether having up to 4 carbons in the alkyl group thereof.

7. The composition of claim 6 wherein the carboxyl-containing polymer is present in lesser amounts than the hydroxyl-containing polymer and the hydroxyl-containing polymer is a partially esterified polyvinylalcohol, and the carboxyl-containing polymer was a molecular weight of at least 20,000 and is a copolymerization product of an alpha-beta dicarboxylic acid having only 4 carbon atoms with a methyl-vinyl ether.

8. The composition of claim 2 wherein the carboxyl-containing polymer is a copolymer of methyl-vinyl ether and maleic anhydride.

9. A method for preparing metal for cold working which comprises applying to the surface of the metal to be cold worked an aqueous dispersion containing 4 ounces to 2 pounds per gallon of a composition essentially consisting of 30 to 75 parts of a water-soluble glass-forming solid pigment selected from the group consisting of alkali metal phosphates and borax, 0 to 10 parts of an alkali metal nitrite, 0 to 2 parts of fine $CaCO_3$, 0 to 10 parts of calcium stearate, 0 to 30 parts of fine inorganic pigment selected from the group consisting of silica aerogels, silica xerogels, fume silica, and barium sulfate, 10 to 80 parts of an alkali metal fatty acid soap having a titre of at least 40°C.; two water-soluble polymers, one being present in amounts of 1 to 10 parts by weight and having a molecular weight above 2,000 being film-forming and having per molecule at least 10 carboxyl-reactive groups, and the other being present in amounts of 0.5 to 4 parts by weight and having a molecular weight of at least 3,000 and having at least 10 carboxyl groups per molecule, and 1 to 5 parts of a surface active agent containing a polyethylene oxide linkage connected to a hydrophobic group, which comprises an alkylphenol, forming a wholly dry molten film on the metal surface from said dispersion by removal of free water at a temperature above the set point of said film, and cooling the film to the solid state, whereby the thus coated metal may be subjected to cold work such as a drawing operation without tearing of the metal and galling of the dies.

10. A method for preparing metal for cold working which comprises applying to the surface of the metal to be cold worked an aqueous dispersion containing 4 ounces to 2 pounds per gallon of a composition consisting essentially of 30 to 75 parts of water-soluble glass-forming pigment which is principally borax, 0 to 10 parts of an alkali metal nitrite, 0 to 2 parts of fine $CaCO_3$, 0 to 10 parts of calcium stearate, 0 to 30 parts of fine inorganic pigment selected from the group consisting of silica aerogels, silica xerogels, fume silica, and barium sulfate, 10 to 80 parts of an alkali metal fatty acid soap having a titre of at least 40°C.; two water-soluble polymers, one being present in amounts of 1 to 10 parts by weight and having a molecular weight above 5,000 and having at least 50 carboxyl reactive groups selected from amine and hydroxyl in molecules thereof, and the other being present in amounts of 0.5 to 4 parts by weight and having a molecular weight of at least 5,000 and having at least 10 carboxyl groups per molecule and a member of the group consisting of mono and diesters of phosphoric acid with a condensation product of ethylene oxide and an alkyl phenol having 6 to 18 carbon atoms in the alkyl group thereof, said condensation products having a poly(ethyleneoxy) portion with 3 to 25 ethyleneoxy units, forming a wholly dry molten film on the metal surface from said dispersion by removal of free water at a temperature above the set point of said film, and cooling the film to the solid state, whereby the thus coated metal may be subjected to cold work such as a drawing operation without tearing of the metal and galling of the dies.

11. The method according to claim 9 wherein the surface active agent is a member of the group consisting of mono and diesters of phosphoric acid with a condensation product of ethylene oxide and an alkyl phenol having 6 to 18 carbon atoms in the alkyl group thereof, said condensation products having a poly-(ethyleneoxy) portion with 3 to 25 ethyleneoxy units,

12. The method according to claim 11 wherein the water-soluble polymer having carboxyl-reactive groups is selected from at least one member of the group consisting of polyvinylalcohol, polyallylalcohol, polysaccharides, amylose fraction of corn starch, methylated and carboxylated derivatives of the foregoing group members, hydroxymethylcellulose, hydroxyethylcellulose, carboxymethylcellulose, and water-soluble condensation products of a foregoing group member with an epoxide selected from ethylene oxide, propylene oxide, butylene oxide, butadiene monoxide and epichlorhydrin.

13. The method according to claim 12 wherein the water-soluble carboxyl-containing polymer coactive with the carboxyl-reactive polymer is a polymerization product of an alpha-beta unsaturated carboxylic acid selected from the group consisting of maleic, fumaric and acrylic acids, with alkyl-vinyl ether having up to 4 carbons in the alkyl group.

14. The method of claim 13 wherein the glass-forming pigment is principally borax and a stream of air is impinged on the molten film thus formed to rapidly chill it to solid state whereby the thus coated metal may be subjected to cold work such as a drawing operation without tearing of the metal and galling of the dies.

15. A method according to claim 14 wherein a thin layer of the aqueous dispersion is applied to the metal when the metal is at a temperature of at least 76.6°C.

16. The method according to claim 14 wherein the metal is at a temperature above 82.2°C. when the molten film is formed and the film is solidified by blasts of air at a temperature below the solidification temperature of the soap.

17. The method according to claim 13 wherein the alkali metal nitrite is sodium nitrite, said esters of phosphoric acid comprise a partial ester of phosphoric acid with a hydroxyl-containing condensate of polyalkylene oxide and nonylphenol and where borax and the soap are the main ingredients in the dry film formed on the metal.

18. A method according to claim 13 wherein the glass-forming pigment is principally borax, the alkali metal soap is sodium stearate.

19. A method according to claim 18 wherein said alkylvinyl ether is methyl-vinyl ether and said alpha-beta carboxylic acid is maleic anhydride.

20. A method according to claim 19 wherein the hydroxyl-containing polymer is a modified polyvinyl alcohol and the carboxyl-containing polymer is a copolymer of methyl-vinyl ether and maleic anhydride having 10 to 50 mole percent maleic anhydride units and a molecular weight of at least 20,000.

21. A method of drawing ferrous metal tubes which comprise immersing the tubes to be drawn in a heated bath of a solution containing 4 ounces to 2 pounds per gallon of composition consisting essentially of 30 to 75 parts of water-soluble glass-forming pigment which is principally borax, 0 to 10 parts of an alkali metal nitrite, 0 to 2 parts of fine $CaCO_3$, 0 to 10 parts of calcium stearate, 0 to 30 parts of fine inorganic pigment selected from the group consisting of silica aerogels, silica xerogels, fume silica and barium sulfate, 10 to 80 parts of an alkali metal fatty acid soap having a titre of at least 40°C.; two water-soluble polymers, one being present in amounts of 1 to 10 parts by weight and having a molecular weight above 5,000 and having at least 50 carboxyl-reactive groups selected from amine and hydroxyl in molecules thereof, and the other being present in amounts 0.5 to 4 parts by weight and having a molecular weight of at least 5,000 and having at least 10 carboxyl groups per molecule and a member of the group consisting of mono and diesters of phosphoric acid with a condensation product of ethylene oxide and an alkyl phenol having 6 to 18 carbon atoms in the alkyl group thereof, said condensation products having a poly(ethyleneoxy) portion with 3 to 25 ethyleneoxy units, draining the tubes of liquid forming a substantially dry molten film on the inner and outer surfaces of the metal tube blanks, permitting the film to solidify, disposing in the tube blanks, a suitable mandrel to bear against the inner surfaces of said tube blanks and passing the tube blanks and mandrel thru a forming die of smaller diameter than the outer diameter of the tube blanks to bear against the outer circumference of the metal being drawn and stretching the metal linearly along the surface of the mandrel at the position of the circumferencial forming die.

22. A method for cold forming of flat, polished, ferrous metal suitable for preparing automobile bumpers without appreciable polishing which comprises applying to the surface of the metal to be cold worked an aqueous dispersion containing 4 ounces to 2 pounds per gallon of a composition consisting essentially of 30 to 75 parts of a water-soluble glass-forming pigment which is principally borax, 0 to 10 parts of an alkali metal nitrite, 0 to 2 parts of fine $CaCO_3$, 0 to 10 parts of calcium stearate, 0 to 30 parts of fine inorganic pigment selected from the group consisting of silica aerogels, silica xerogels, fumic silica and barium sulfate, 10 to 80 parts of an alkali metal fatty acid soap having a titre of at least 40°C.; two water-soluble polymers, one being present in amounts of 1 to 10 parts by weight and having a molecular weight above 5,000 and having at least 50 carboxyl-reactive groups selected from amine and hydroxyl in molecules thereof, and the other being present in amounts of 0.5 to 4 parts by weight and having a molecular weight of at least 5,000 and having at least 10 carboxyl groups per molecule and a member of the group consisting of mono and diesters of phosphoric acid with a condensation product of ethylene oxide and an alkyl phenol having 6 to 18 carbon atoms in the alkyl group thereof, said condensation products having a poly (ethyleneoxy) portion with 3 to 25 ethyleneoxy units forming a wholly dry molten film on the metal surfaces from said dispersion by removal of free water at a temperature above the set point of said film, setting the molten film to the solid state and drawing the metal in the desired shape with the aid of a suitable pair of forming dies.

23. The method according to claim 21 wherein the carboxyl-reactive polymer is a partly esterified polyvinyl alcohol and the carboxyl-containing product of an alpha-beta unsaturated dicarboxylic acid having only 4 carbon atoms with methyl-vinyl ether which copolymerization product has a molecular weight above 20,000.

24. The method of claim 22 wherein the carboxyl-reactive polymer is a partly esterified polyvinyl alcohol and the carboxyl-containing product of an alpha-beta unsaturated dicarboxylic acid having only 4 carbon atoms with methyl-vinyl ether which copolymerization product has a molecular weight above 20,000.

* * * * *